US011737540B2

(12) United States Patent
Smith

(10) Patent No.: US 11,737,540 B2
(45) Date of Patent: Aug. 29, 2023

(54) BRUSH ASSEMBLY

(71) Applicant: Imani Smith, Sherman Oaks, CA (US)

(72) Inventor: Imani Smith, Sherman Oaks, CA (US)

( * ) Notice: Subject to any disclaimer, the term of this patent is extended or adjusted under 35 U.S.C. 154(b) by 198 days.

(21) Appl. No.: 17/386,478

(22) Filed: Jul. 27, 2021

(65) Prior Publication Data

US 2023/0035204 A1 Feb. 2, 2023

(51) Int. Cl.

| | |
|---|---|
| ***A45D 24/22*** | (2006.01) |
| ***A46B 11/00*** | (2006.01) |
| ***A46B 17/04*** | (2006.01) |
| ***A46B 9/02*** | (2006.01) |

(52) U.S. Cl.

CPC ..... *A45D 24/22* (2013.01); *A46B 9/023* (2013.01); *A46B 11/0062* (2013.01); *A46B 17/04* (2013.01); *A46B 2200/104* (2013.01)

(58) Field of Classification Search

CPC .. A45D 34/042; A45D 24/22; B65D 83/0011; A46B 2200/104; A46B 2200/102; A46B 9/023; A46B 17/04; A46B 11/0089; A46B 11/0065; A46B 11/0062; A46B 11/0027; A46B 11/002; A46B 11/001; A46B 11/00; A46B 5/02; A46B 5/0095; A46B 5/0012; A46B 5/0008

See application file for complete search history.

(56) References Cited

U.S. PATENT DOCUMENTS

| | | | | | |
|---|---|---|---|---|---|
| 1,486,394 | A * | 3/1924 | Smith | A46B 11/0027 | 401/175 |
| 1,943,893 | A * | 1/1934 | Johnson | A46B 11/0027 | 401/175 |
| 2,416,684 | A * | 3/1947 | Fischer | A46B 5/0095 | 15/167.1 |
| 4,062,635 | A * | 12/1977 | Teh-Sheng | A46B 11/0027 | 401/175 |
| D321,287 | S * | 11/1991 | Woll | D4/106 | |
| 5,960,801 | A * | 10/1999 | Vermooten | A46B 17/04 | 132/286 |
| D890,529 | S * | 7/2020 | Choi | A46B 9/045 | D4/120 |
| D945,164 | S * | 3/2022 | Ivory | A46B 11/0027 | D4/119 |
| 2010/0236006 | A1* | 9/2010 | Deng | A46B 9/045 | 15/167.2 |

* cited by examiner

*Primary Examiner* — Patrick M. Buechner
(74) *Attorney, Agent, or Firm* — Steven Rinehart

(57) ABSTRACT

A brush having a brush head, a neck, a concave crown and handle defining a hollow interior recess, the brush ergonomically adapted to contour a user's grip. The brush may comprise, in some embodiments, a container having two receptacles.

8 Claims, 11 Drawing Sheets

BRUSH ASSEMBLY

FIELD OF THE INVENTION

This invention relates to brushes and personal grooming implements and more particularly relates to a stylized brush.

BACKGROUND

Description of the Related Art

In general, brushes comprise elongated handles and a pad, which may be flexible, from which a plurality of bristles protrude. The bristles may be metal or polymeric and extend outwardly. Brushing is performed with a horizontal motion of the brush through the hair. As the brush is moved through hair, the brush detangles, removes larger particles and provides a gentle massage effect.

Brushes known in the art tend to comprise only simple mechanical devices often formed as a single integrated piece. Because users concerned with hair styling have stylist preferences, brushes which are themselves stylized have commercial appeal to these users. A brush which is adapted to perform ergonomic and utilitarian function is not known in the art.

It is desirable, and an object of the present invention, to provide an apparatus in the form of a brush which improves upon known devices.

SUMMARY

From the foregoing discussion, it should be apparent that a need exists for an improved brush and applicator. Beneficially, such a device would overcome inefficiencies with the prior art by providing a stylized brush with optimal ergonomic function.

The present invention has been developed in response to the present state of the art, and in particular, in response to the problems and needs in the art that have not yet been fully solved by currently available apparti. Accordingly, the present invention has been developed to provide a brush comprising: a brush head comprising an obverse and reverse face; two diametrically-opposing planar pads, each pad defining a plurality of apertures adapted to receive a proximal end of a bristle; a frustoconical neck interconnecting the brush head with a crown; wherein the crown comprising a plurality of inferiorly-jutting prongs, each prong having a cantilever, the prongs adapted to form a snap fit with a handle; a flange disposed between the crown and the frustoconical neck; an elongated threaded shaft affixed to a cylindrical disk and a hexagonal protuberance, the elongated threaded shaft adapted to threadably join the brush head and neck together; a handle defining a hollow interior recess, the handle comprising: an annular ring inserted into the hollow interior recess; a threaded end cap.

The brush head may be diamond shaped. The handle may be cylindrical. The end cap may be detachable to provide access to product within the hollow interior recess.

The crown, in some embodiments, is concavedly-recessed inwardly around a midsection circumscribing the crown.

The brush may further comprise a plurality of bristles extending laterally from each planar pad.

The brush, in some embodiments, further comprises a container adapted to envelop the brush head, the container comprising two hingedly-connected receptacles adapted to snap shut using a snap fit, one or more of the receptacles comprising a prong adapted to engage a receptacle.

The receptacles may be hingedly affixed using a live hinge.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Figure 1A:
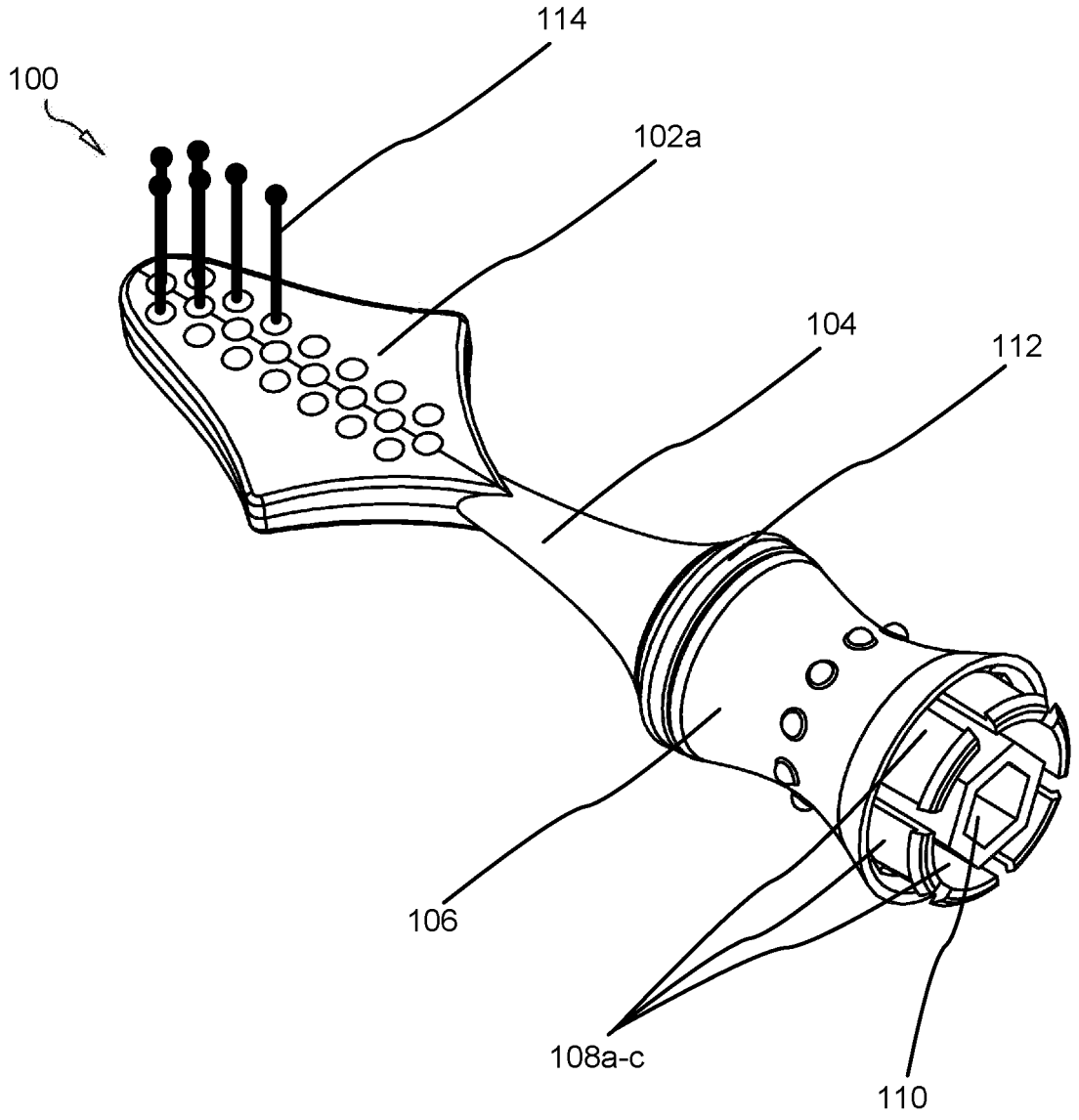
FIG. 1A is an isometric perspective view of a brush assembly in accordance with the present invention.
Figure 1B:
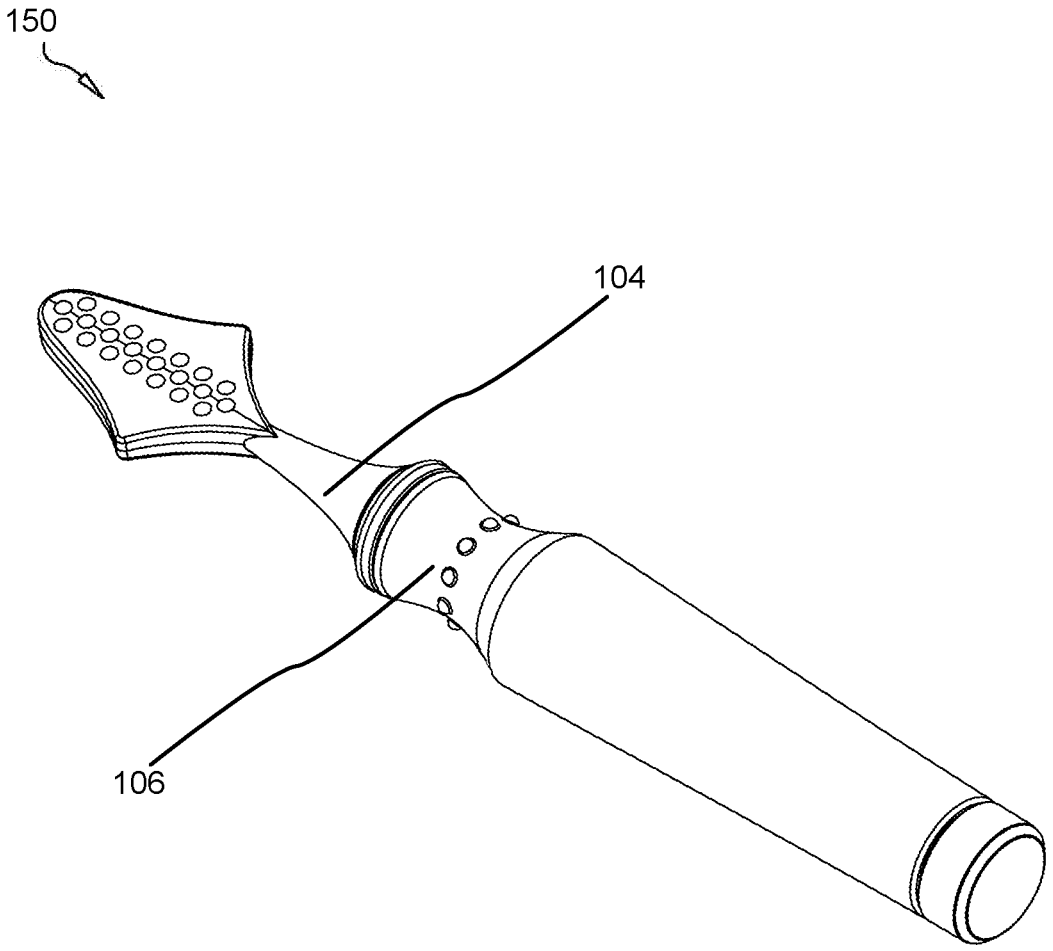
FIG. 1B is an isometric perspective view of a brush in accordance with the present invention.
Figure 2:
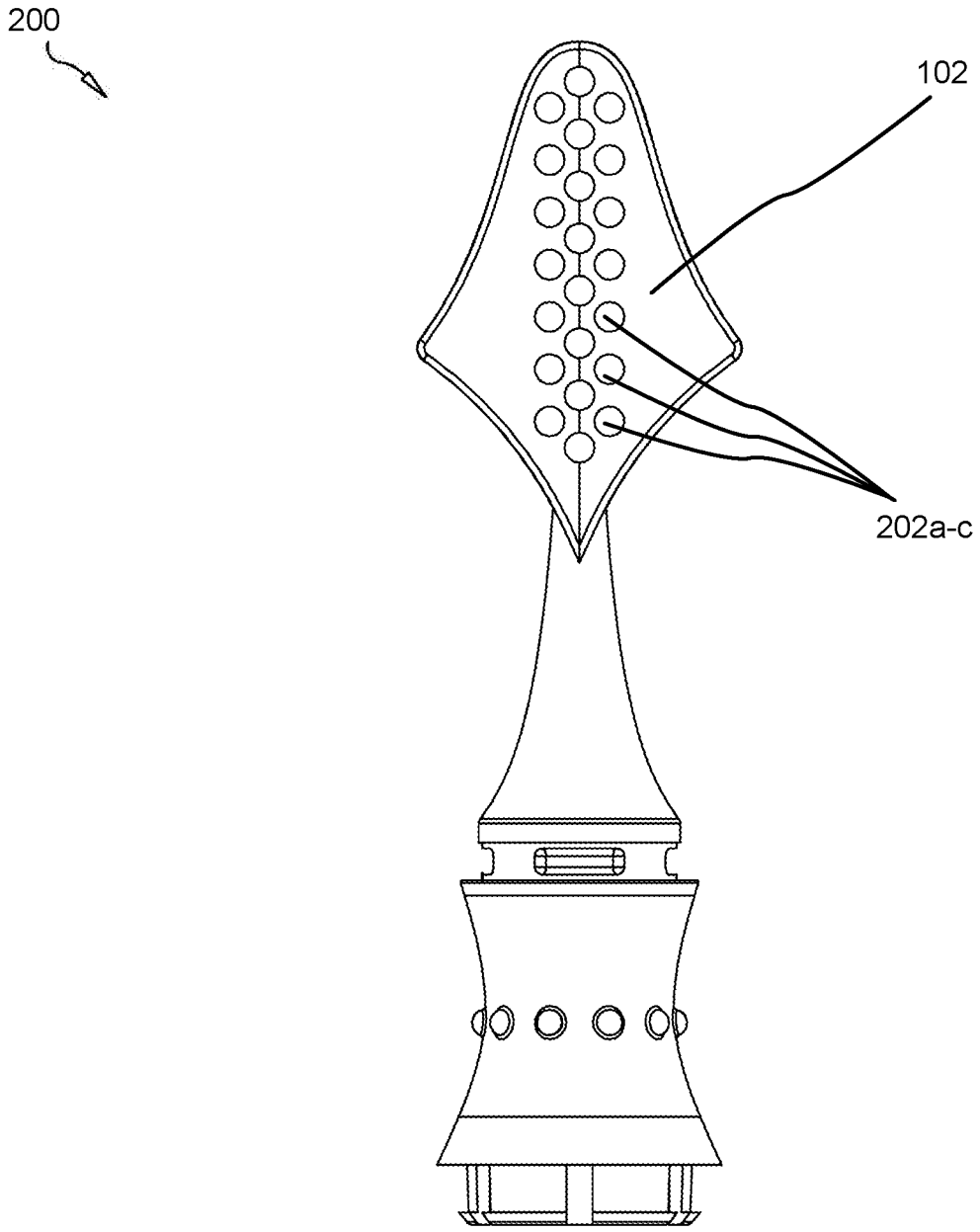
FIG. 2 is a forward perspective view of a brush in accordance with the present invention.
Figure 3:
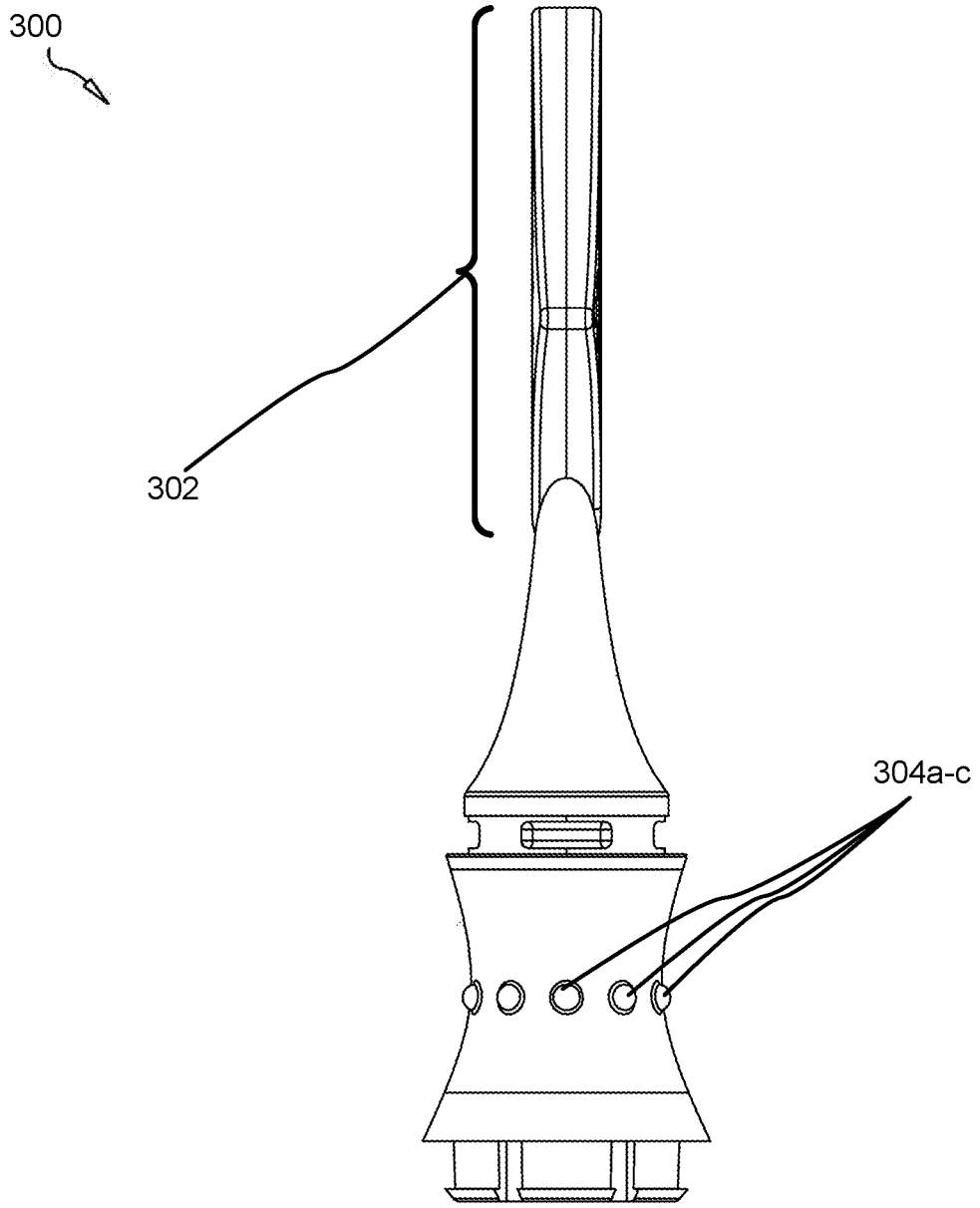
FIG. 3 is a forward perspective view of a brush in accordance with the present invention.
Figure 4:
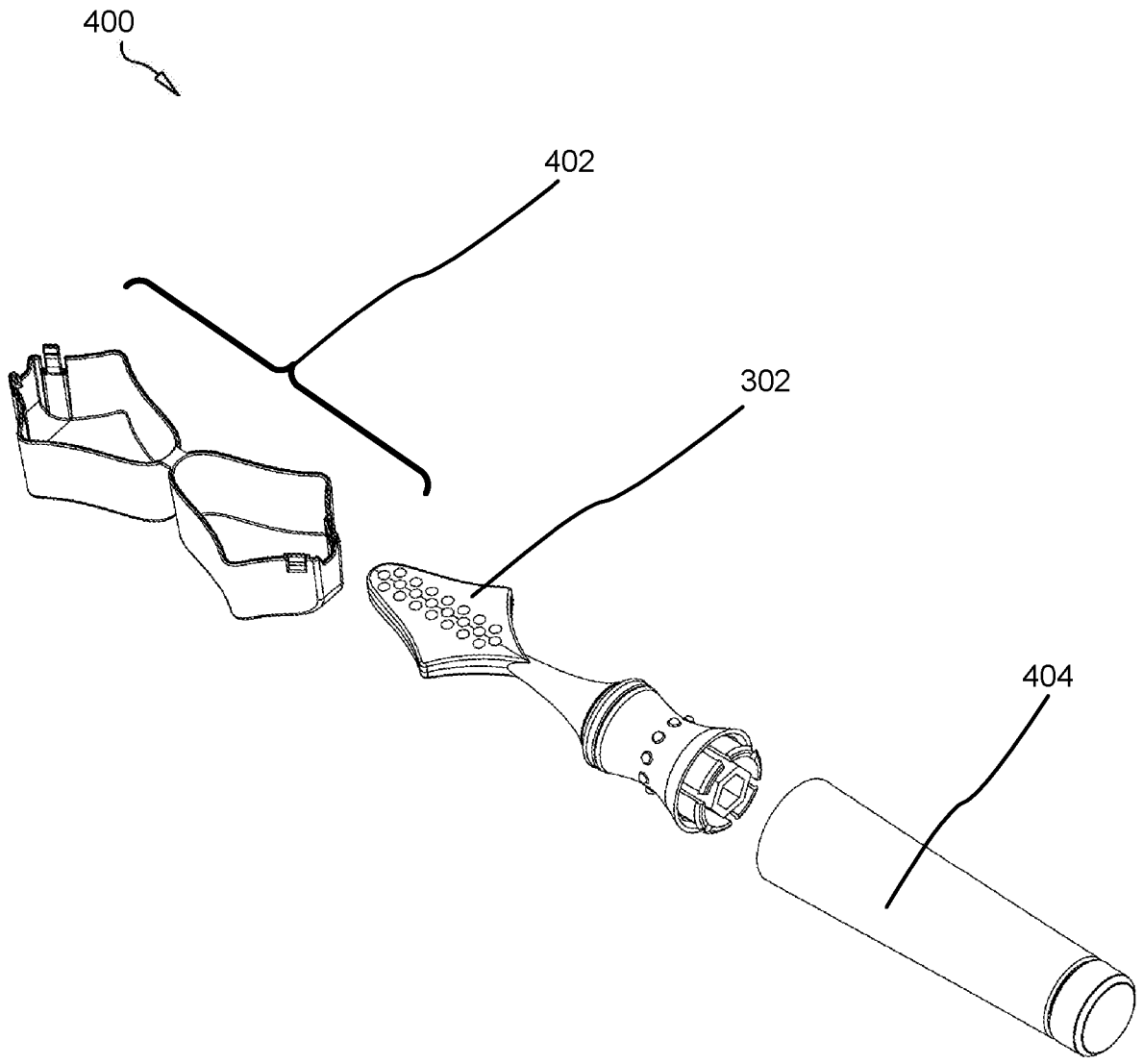
FIG. 4 is an exploded view of a brush in accordance with the present invention.
Figure 5:
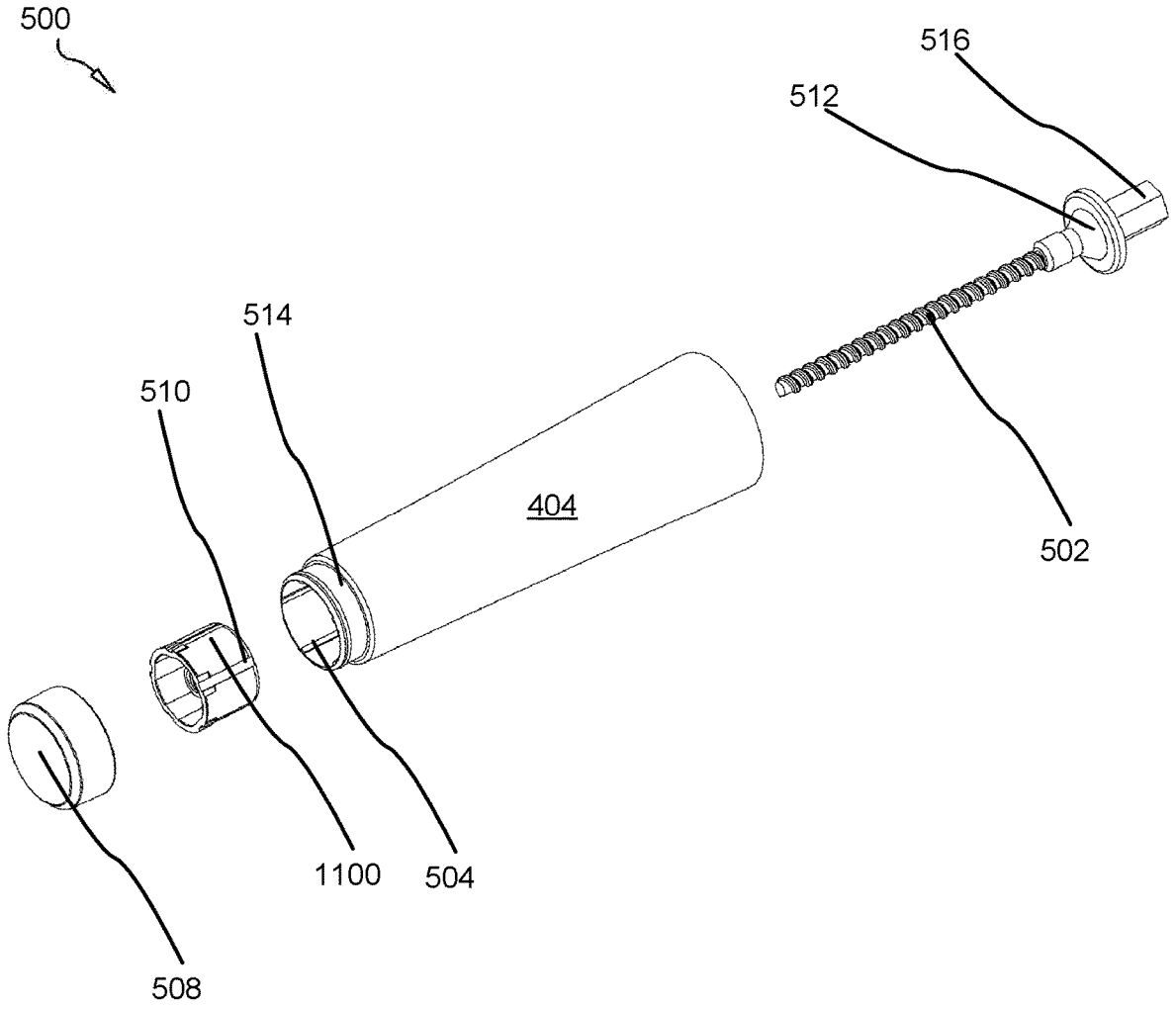
FIG. 5 is an exploded view of a brush in accordance with the present invention.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

FIGS. 1-5 illustrate different perspective views of a brush assembly 100 in accordance with the present invention.

The brush 100, 200, 300 comprises a brush head 302 having an obverse face 102*a* and a reverse face 102*b*. Each face 102 defines a plurality of bores or apertures 202 from which bristles 114 may protrude. These bristles 114 may vary is length, thickness and rigidity. In some embodiments, the brush head 302 is diamond shaped, but may also be circular, ovoid, rectangular or irregularly shaped.

The brush head 302 is connected to a neck 104 which may comprise a tubular or frustoconical component which tapers superiorly to meet the brush head 302. The neck 104 and the brush head 302 may be formed as a single integrated piece.

A horizontal aperture 306 may dispose between the neck 104 and the crown 106 from which product may be dispensed.

In some embodiments, one or more flanges 112 may position between the neck 104 and crown 106.

In various embodiments, the brush 100 comprises a crown 106 disposed inferiorly to the neck 104. The crown 106 may also comprise a substantially tubular or cylindrical component which is recess around a midsection on the longitudinal axis to define a concave recess circumscribing the crown 106.

The crown 106 may define a bore which runs longitudinally throughout the crown 106 which is adapted to receive a threaded, elongated shaft 502 in some embodiments. Alternatively, the elongated shaft 502 traverses the handle 404 longitudinally. The threaded, elongated shaft 502 may be affixed at a distal end to a disk 512 and a hexagonal protuberance 516. The protuberance 516 may alternatively be square, rectangularly, octagonal, or otherwise shaped. The protuberance 516 is adapted to mate with the protuberance 110, which protuberance 110 may hold the protuberance 516 axially in place.

In various embodiments, hair product is housed within the handle 404.

A plurality of round protuberances 304 may jut laterally from the crown 106 at regularly- or irregularly-spaced intervals.

In some embodiments, the handle 404 comprises a cylindrical or tubular member which tapers as shown toward either the distal or proximal end. The handle 404 may define a hollow interior recess into which an annular ring 506 is inserted. The annular ring 506 and/or the interior surface of the handle 404 may define a track 510 adapted to receive a corresponding outwardly-protruding guide rail 504 to prevent the annular ring 506 from rotating axially within the handle 404. The various embodiments, the annular ring 506 comprises a shuttle which travels within the handle 404. The shuttle 506 may be adapted to extrude product in the form or a solid stick-like wax, balm, or viscous material. The shuttle 506 may be adapted to travel distally or proximally as the hexagonal protuberance 516 is rotated.

In some embodiments, the handle 404 comprises a dispenser cut 1100 which inserts into the hollow recess 1002 defined by the handle 404.

Figure 6:
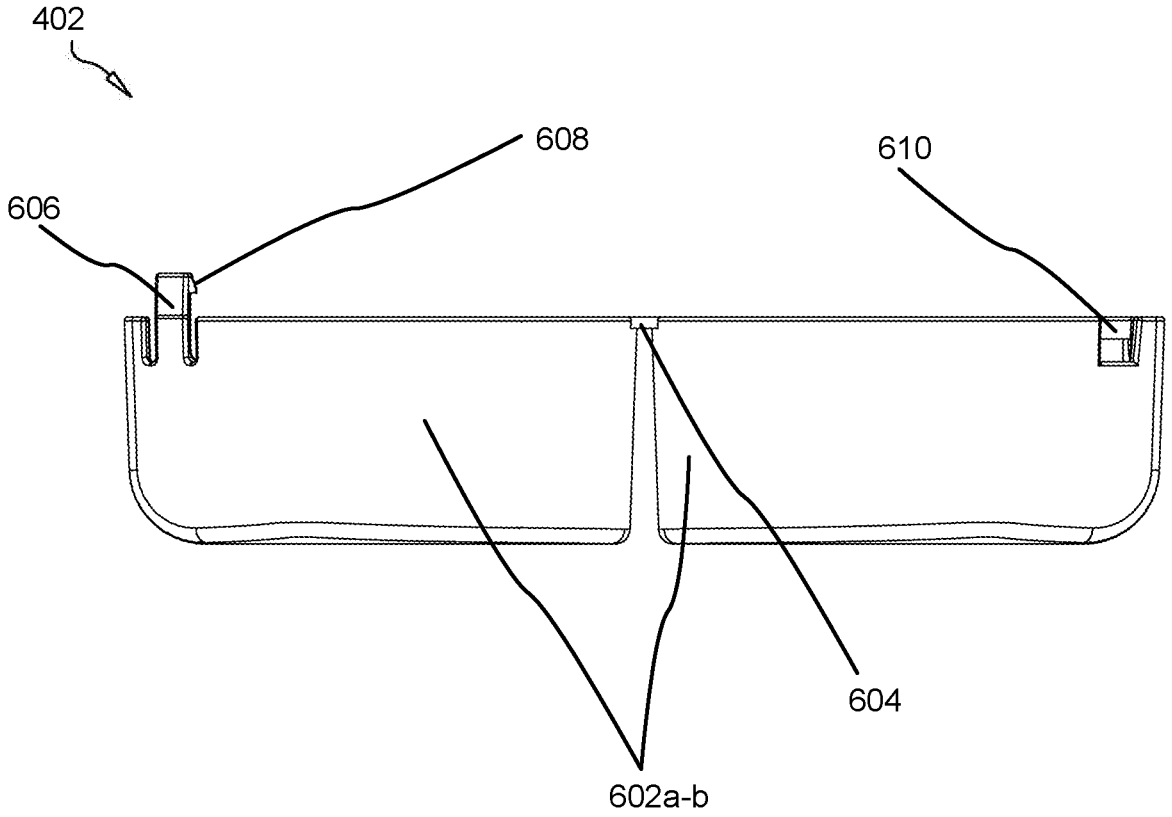
FIG. 6 is a side perspective view of a container for the head of a brush assembly in accordance with the present invention.

FIG. 6 is a side perspective view of a container for the head of a brush 402 in accordance with the present invention.

The container 402 comprises two receptacles 602 each with an open top end. The receptacles 602 may be adapted to contour an exterior shape of the brush head 302. The receptacles 602 may be hingedly affixed to one another and the hinge may comprise a liver hinge.

In various embodiments, the receptacles 602 are formed as a single integrated piece. One or more of the receptacles 602 may comprise one or more prongs 606 protruding from a top edge of the receptacle adapted to mate with an opposing receptacle and form a snap fit with a prong recess 610 on the opposing receptacle 602. The prong 606 may comprise a declined cantilever 608.

Figure 7:
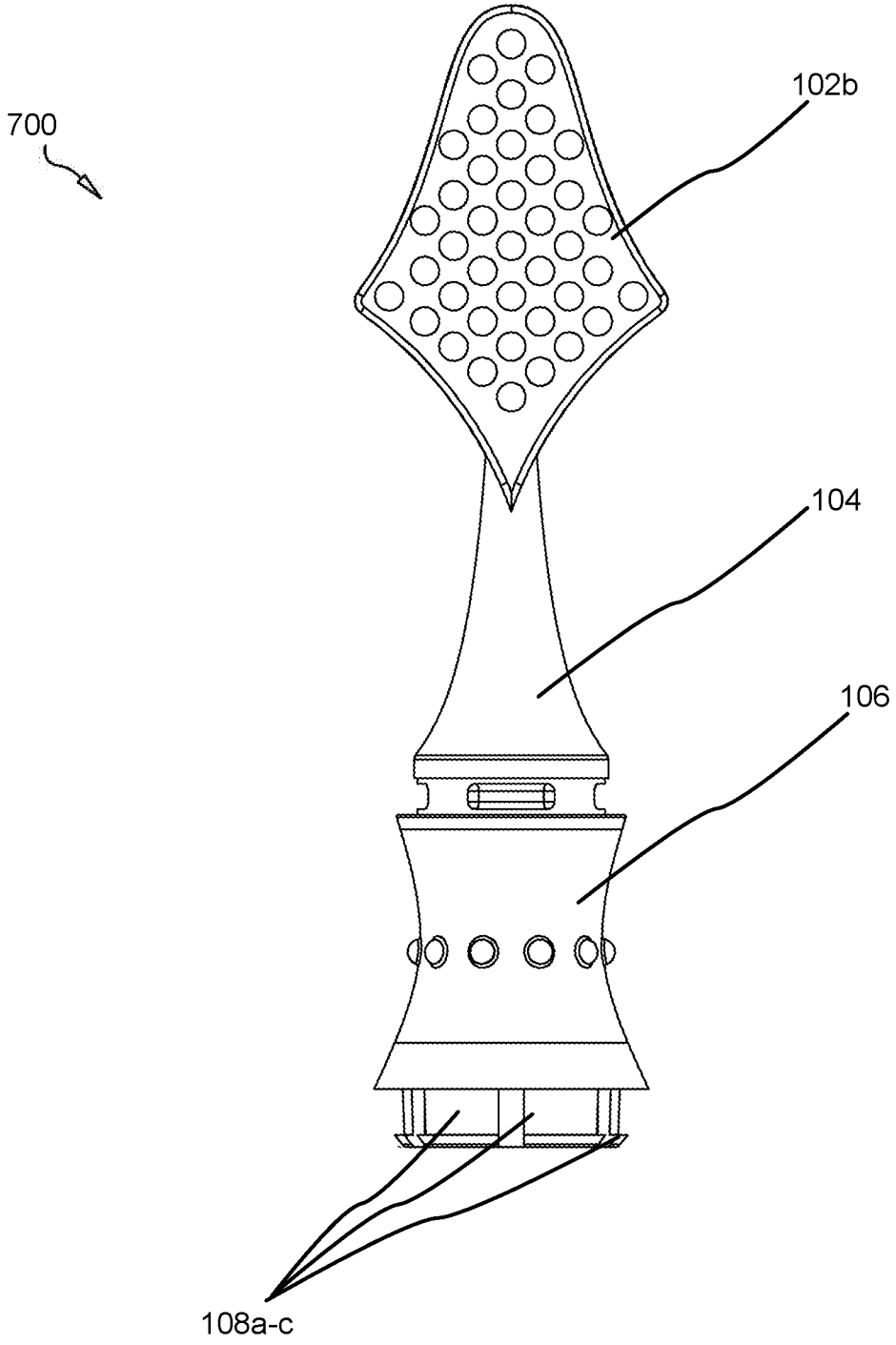
FIG. 7 is a rear perspective view of a brush in accordance with the present invention.

FIG. 7 is a rear perspective view of a brush in accordance with the present invention.

The obverse and reverse faces of the brush head 302 may define a different quantity and differently-shaped arrangement of apertures 202.

Figure 8:
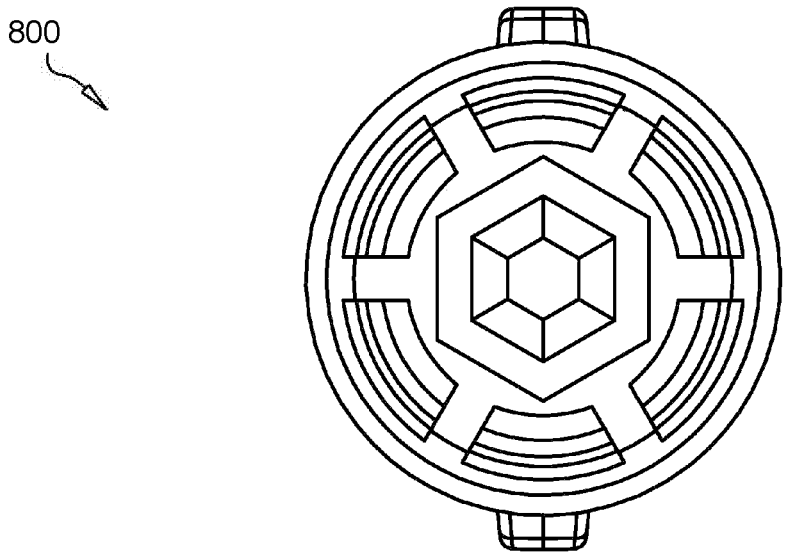
FIG. 8 is a lower perspective view of a brush in accordance with the present invention.
Figure 9:
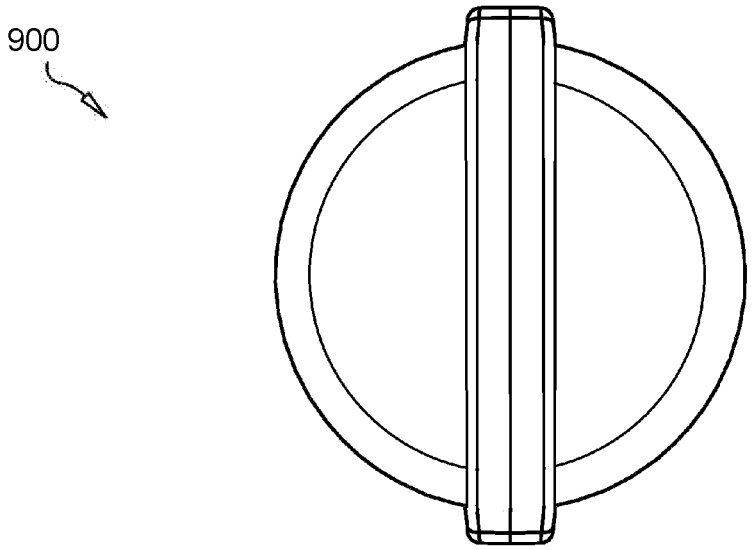
FIG. 9 is a top perspective view of a brush in accordance with the present invention.

FIGS. 8-9 illustrate a lower perspective view of a brush in accordance with the present invention as shown.

Figure 10:
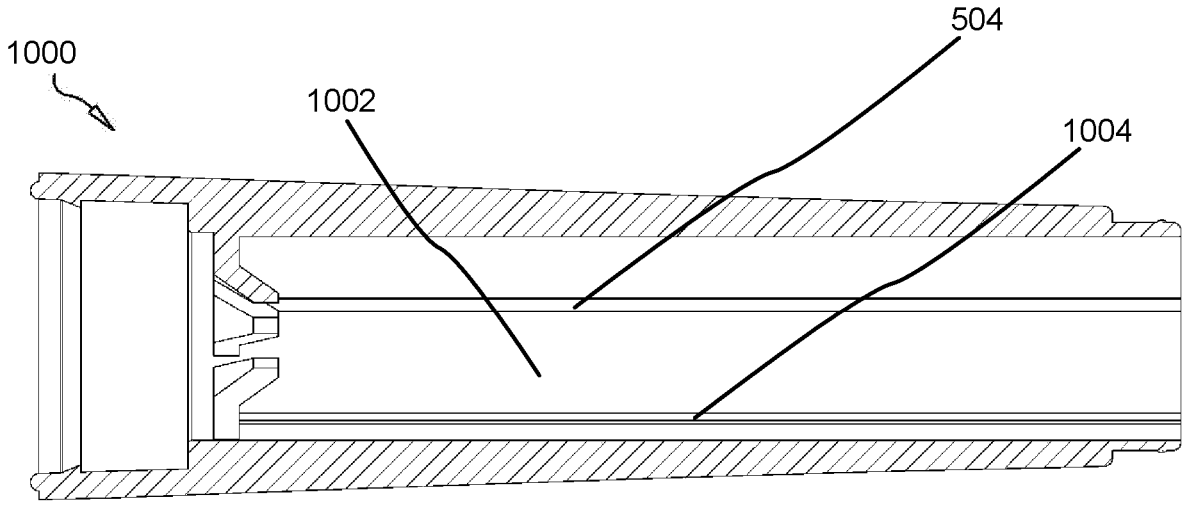
FIG. 10 is a section perspective view of a handle of a brush assembly in accordance with the present invention.

FIG. 10 is a section perspective view of a handle 404 of a brush assembly in accordance with the present invention. As shown.

Figure 11A:
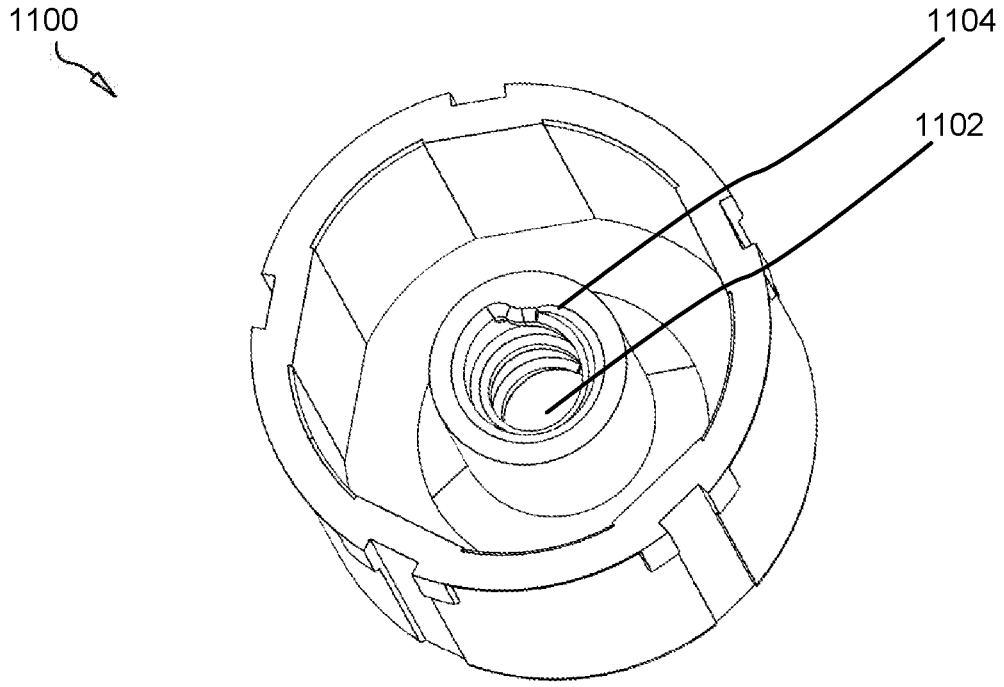
FIG. 11A is a top perspective view of a dispenser cup of a brush assembly in accordance with the present invention.
Figure 11B:
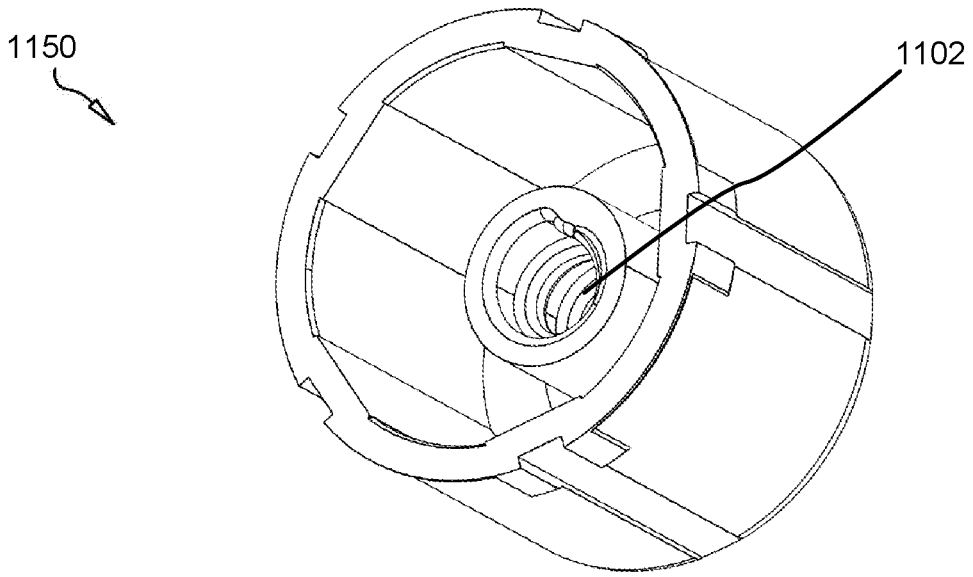
FIG. 11B is a perspective view of a dispenser cup of a brush assembly in accordance with the present invention.

FIGS. 11A-11B are perspective views of a dispenser cup 1100 of the brush assembly in accordance with the present invention.

An aperture 1102 (or bore) positions centrically within the cup 1100 through which the elongated shaft 502 extends. The cup 1100 comprises a cylindrical protuberance 1104 which is notched as shown. The dispenser cup 1100 travels along the threaded shaft 502 to dispense the product inferiorly from the handle 404.

Figure 12:
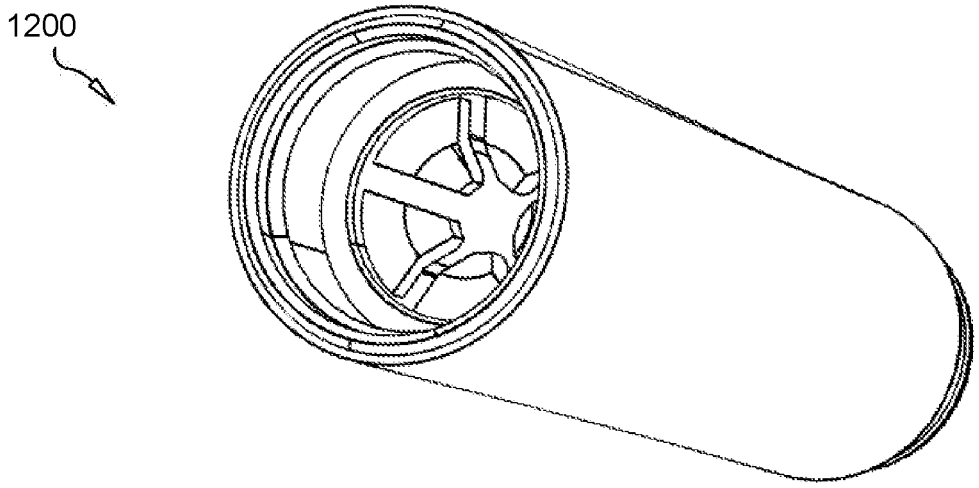
FIG. 12 is a perspective view of a handle of a brush assembly in accordance with the present invention.

FIG. 12 is a perspective view of a handle of a brush assembly in accordance with the present invention.

As shown.

In summary of the above, the following key is provided:

The component indicated at 102*a* is the obverse face.

The component indicated at 102*b* is the reverse face.

The component indicated at 104 is a neck.

The component indicated at 106 is a crown.

The component indicated at 108 is snap prong.

The component indicated at 110 is a hexagonal protuberance.

The component indicated at 114 is a bristle.

The component indicated at 202 is a bore.

The component indicated at 302 is the brush head.

The component indicated at 304 is a bulbous protuberance.

The component indicated at 402 is the containers for the brush head 302.

The component indicated at 404 is the handle.

The component indicated at 502 is the elongated, threaded shaft.

The component indicated at 504 is a guide rail.

The component indicated at 506 is the annular ring or shuttle.

The component indicated at 508 is the end cap.

The component indicated at 510 in a guide track.

The component indicated at 512 is a disk.

The component indicated at 514 is the recessed annual lower edge of the handle 404.

The component indicated at 516 is a hexagonal protuberance.

The component indicated at 602 is a receptacle.

The component indicated at 604 is a live hinge.

The component indicated at 606 is a prong.

The component indicated at 608 is a prong cantilever.

The component indicated at 610 is a prong recess.

The component indicated at 1002 is a hollow recess.

The component indicated at 1004 is an interior wall of the handle.

The component indicated at 1102 is a bore.

The component indicated at 1104 is a cylindrical protuberance.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A brush comprising:

a brush head comprising an obverse and reverse face;

two diametrically-opposing planar pads, each pad defining a plurality of apertures adapted to receive a proximal end of a bristle;

a frustoconical neck interconnecting the brush head with a crown;

wherein the crown comprising a plurality of inferiorly-jutting prongs, each prong having a cantilever, the prongs adapted to form a snap fit with a handle;

one or more flanges disposed between the crown and the frustoconical neck;

an elongated threaded shaft affixed to a cylindrical disk and a hexagonal protuberance;

a handle defining a hollow interior recess, the handle comprising:

an annular ring inserted into the hollow interior recess;

a threaded end cap.

2. The brush of claim 1, wherein the brush head is diamond shaped.

3. The brush of claim 1, wherein the handle is cylindrical.

4. The brush of claim 1, wherein the end cap is detachable to provide access to the hollow interior recess for putting hair product therein.

5. The brush of claim 1, wherein the crown is concavedly-recessed inwardly around a midsection circumscribing the crown.

6. The brush of claim 1, further comprising a plurality of bristles extending laterally from each planar pad.

7. The brush of claim 1, further comprising a container adapted to envelop the brush head, the container comprising two hingedly-connected receptacles adapted to snap shut using a snap fit, one or more of the receptacles comprising a prong adapted to engage a receptacle.

8. The brush of claim 7, wherein the receptacles are hingedly affixed using a live hinge.

* * * * *